US005704606A

United States Patent [19]

Kim

[11] Patent Number: 5,704,606

[45] Date of Patent: Jan. 6, 1998

[54] SHEET FEEDING APPARATUS FOR A PRINTER

[75] Inventor: An-Kuk Kim, Kyungki-do, Rep. of Korea

[73] Assignee: Samsung Electronics Co., Ltd., Rep. of Korea

[21] Appl. No.: 734,416

[22] Filed: Oct. 17, 1996

[30] Foreign Application Priority Data

Oct. 17, 1995 [KR] Rep. of Korea ..... 95-29097

[51] Int. Cl.[6] ..... B65H 5/00

[52] U.S. Cl. ..... 271/10.13; 271/10.05; 271/114

[58] Field of Search ..... 271/10.11, 10.1, 271/10.09, 10.13, 10.05, 114

[56] References Cited

FOREIGN PATENT DOCUMENTS

| | | | |
|---|---|---|---|
| 361169428 A | 7/1986 | Japan | 271/10.13 |
| 0022738 | 1/1989 | Japan | 271/114 |
| 406171780 A | 6/1994 | Japan | 271/114 |
| 406263279 A | 9/1994 | Japan | 271/10.11 |

*Primary Examiner*—H. Grant Skaggs

*Attorney, Agent, or Firm*—Banner & Witcoff, Ltd.

[57] ABSTRACT

A sheet feeding apparatus for use in a printer is disclosed. The apparatus according to a preferred embodiment of the present invention includes a pick-up gear coaxially linked with a pick-up roller for picking up a sheet; a feed gear coaxially linked with a feed roller for transmitting a picked-up sheet to a location for printing; a driving gear in substantially rectangular shape, driven by a driving force applied from a motor; a change gear engaged with the driving gear and slidingly movable along the peripheral surface thereof, for transferring a driving force applied from the driving gear to one of either the pick-up gear or feed gear; a switching lever pivotly mounted on a shaft connected to the body of the printer, said level being swiveled with respect to the shaft when a carriage pushes an arm thereof, and for causing the change gear to be released from an engagement with the feed gear and to be meshed with the pick-up gear; a guide bar fixedly installed on the body of the printer, for guiding in the axial direction the change gear to slidingly move along the peripheral surface of the driving gear; and an elastic member elastically installed around the guide bar to shift the change gear from an engagement with the pick-up gear to an engagement with the feed gear, whereby the driving force produced from the mother is able to be transferred to the feed roller.

2 Claims, 1 Drawing Sheet

SHEET FEEDING APPARATUS FOR A PRINTER

CLAIM OF PRIORITY

This application makes reference to, incorporates the same herein, and claims all benefits accruing under 35 U.S.C§119 from an application for SHEET FEEDING APPARATUS FOR A PRINTER earlier filed in the Korean Industrial Property Office on 17 Oct. 1995 and there duly assigned Serial No. 29097/1995 by that Office.

Field of The Invention

The present invention relates in general to a sheet feeding apparatus, and more particularly, to an apparatus for picking up and feeding a sheet use with a printer. In the apparatus, a driving force is transmitted to a pick-up gear via a change gear engaged with a driving gear by utilizing an interaction between a switching lever and a carriage mounting a write head therein during an operation for picking up a sheet from a tray. In addition, during a sheet feeding operation for printing, a driving force is transmitted to a feed gear via a change gear which is moved to mesh with the feed gear, unfixed from a pick-up gear by a restoring force of an elastic member and The apparatus is improved to more exactly switch one of a pick-up operation and a sheet feeding operation, regardless any wear and tear of gears.

BACKGROUND OF THE INVENTION

Contemporary practice in the art typically uses an widely known auto sheet feeding process for printing or portraying chatterers or graphics or a sheet or a recording medium in a printer such as, for example, an ink jet or laser printers. The process above includes the steps of automatic feeding a sheet from an auto sheet feeding (ASF) cassette containing a bundle of sheets by a pick-up roller, transferring a sheet being fed to a guide portion by a transfer gear, printing a character on a transferred sheet by a write head and delivering a printed sheet to an external tray by an operation of a delivery roller and plurality of wheel stars. This type of sheet feeding device requires separate driving mechanism for both pick-up roller and feed roller.

A conventional sheet feeding device, as illustrated in FIG. 1 as an exemplar, is often constructed with a pick-up gear 10, coaxially linked with a pick-up roller disposed for picking up a sheet; a feed gear 20' coaxially linked with a feeding gear for feeding a picked-up sheet to a location suitable for printing or portraying characters or graphics; a driving gear 30' swiveling in a round or reverse direction by the driving force of a motor; transfer gear 100, being geared with a driving gear 30', which transfers the driving force to either one of pick-up gear 10' or feed gear 20'; a pair of first and second change gear **40'*a* and 40'*b* meshed in series with transfer gear 100; a fixed bracket 110 disposed for integrally linking transfer gear 100 and first change gear 40'*a* and a relaying bracket 120 arranged to link first and second change gears 40'*a* and 40'*b*, and disposed to coaxially mounted on a shaft 41 so as to allow second change gear 40'*b* to roll side to side by virtue of friction force with a first change rear 40'*a*, such that second change gear 40'*b* may be meshed with one of either a pick-up gear 10' or feed gear 20'**.

A conventional type of sheet feeding device as constructed above, drives the driving force of a driving gear 30' to be transferred to transfer gear 100, first change gear **40'*a*, second change gear 40'*b* and in turn feed gear 20' at an ordinary occasion in normal state since second change gear 40'*b* is engaged with feed gear 20'** so that a sheet is able to be transmitted to a proper location for printing.

During an operation for performing sheet feeding in the device above described state, driving gear 30' turns round clockwise, transfer gear 100 counterclockwise, first change gear **40'*a* clockwise, second change gear 40'*b* counterclockwise and in turn feed gear 20' turns round to clockwise direction. On this occasion, relay bracket 120 turns round clockwise with respect to shaft 41 under the influence of clockwise turning effect of first change gear 41'*a*** owing to a friction force generated at contact surface therebetween.

The rotation of relaying bracket 120 as described above in the direction of clockwise, causes second change gear **40'*b* to move and mesh with feed gear 20' so that a picked-up sheet is able to locate at a proper position for printing. In order to automatically pick up s sheet in a cassette, a pick-up gear 10' is to rotate by a driving force transferred from driving gear 30' in response to a pick-up signal applied from an external source (not shown). Upon receiving the above pick-up signal, driving gear 30' is initiated to reverse direction and thereby drives transfer gear 100 to turn round clockwise, first change gear 40'*a* to anti-clockwise, second change gear 40'*b* to clockwise and in turn feed gear 20'** to round also anti-clockwise, respectively.

Due to a friction force produced at a contact surface with an end of first change gear **40'*a*, relaying bracket 120 is compelled to round anti-clockwise with respect to shaft 41 under the influence of anti-clockwise turning effect of first change gear 40'*a*, allowing second change gear 40'*b* to unlock from feed gear 20', and thereby causing pick-up gear 10' to mesh with second change gear 40'*b***, an individual sheet is picked up from a cassette for ready to printing.

As described above, a printing operation is performed in a printer by repeated pick-up and sheet feeding process. I have observed that the above explained conventional sheet feeding device have drawbacks. First, the device above requires to maintain predetermined clearances among transfer gear 100, first and second change gear **40'*a* and 40'*b*** so as to perform a normal operation.

Due to repeated use; however any one of either first or second change gear **40'*a* or 40'*b* might become wear and tear, creating a gap therebetween, hindering overall performance of driving force transfer from a motor and thereby causing a malfunction to any one of pick-up gear 10' or feed gear 20'. In other words, when picking up a sheet from a tray, pick-up gear 10** might be eventually stopped while second change gear turns round anti-clockwise.

At this time, a clearance between first and second change gears **40'*a* and 40'*b* allows second change gear 40'*b* to idle as so as much without causing pick-up gear 10' to turn during an initial stage of engagement therebetween. Simultaneously, a reaction force instantaneously produced in response to the turning effect of second change gear 40'*b* with respect to static friction of pick-up gear 10, permits second change gear 40'*b* to deviate from pick-up gear 10' over bounding force of friction between first change gear 40'*a* and relaying bracket 120. As a result, second change gear 40'*b* is bounced from pick-up gear 10 at an initial stage of engagement and then forced to again move adjacent to pick-up gear 10' by a friction force produced at a clearance between first change gear 40'*a* and relaying bracket 120**.

Again, second change gear **40'*b* is repelled by the reaction described above. Second, first change gear 40'*a* is coaxially mounted with relaying bracket 120 by a linking shaft 41 and is arranged to be disposed so as to produce a certain degree of friction force at contact surfaces of both second change gear 40'b and relaying bracket 120 so that second change gear 40'b being shifted between and to pick-up gear 10' and feed gear 20'. If the friction force becomes more than over a predetermined value, then it hinders smooth rotation of second change gear 40'b toward pick-up gear 10'. In contrast, smaller friction force may even detrimentally jeopardize the normal switching operation of second change gear 20'**.

Based upon my study of contemporary art, I believe that there is a need for effectively switching a gear between and to a pick-up gear and a feed gear, without fail, in a sheet feeding apparatus for use in a printer.

SUMMARY OF THE INVENTION

Accordingly, it is an object of the present invention to provide an improved sheet feeding apparatus.

It is another object of the present invention to provide a sheet feeding apparatus for use with a printer, which utilizes operations of a level and a write head in the printer. It is still another object of the present invention to provide a sheet feeding apparatus, in which a driving force is transferred to a pick-up gear during pick-up operation via a movable change gear.

It is yet another object of the present invention to provide a sheet feeding apparatus, in which a driving force is transferred to a feed gear during feeding operation for a picked-up sheet via a change gear being unlocked by restoring force of an elastic member and engaged with the feed gear.

It is still yet another object of the present invention to provide a sheet feeding apparatus capable of effectively switching a change gear between feed gear and pick-up gear regardless of wear of any gears.

To achieve these and other objects, there is provided a sheet feeding apparatus for use with a printer that includes a pick-up gear coaxially linked with a pick-up roller disposed for picking up a sheet; a feed gear coaxially linked with a feed roller that transmits the picked-up sheet to a proper location for printing operation; a driving gear in substantially rectangular shape, that rotates in a forward or reward directions by a driving force applied from a motor; a change gear in mesh with and slidingly movable with respect to the driving gear so as to transfer a driving force to a pick-up gear or feed gear; a switching lever disposed to be mounted on a shaft located at substantially middle portion of the body of a printer, for turning round with respect to the shaft by a pulling force applied from a carriage so that an end portion thereof pushes a change gear to slidingly switch from a feed gear to a pick-up gear; a guide bar fixedly installed on the body of a printer, for guiding a change gear to slidingly move in the axial direction along the surface of the driving gear and an elastic member provided on the guide bar to elastically push a change gear so as to mesh with a feed gear.

By using an operational movement of a switching level subsequent to a carriage movement, a change gear is forced to slidingly move toward a motor so as to be engaged with a pick-up gear, during sheet pick-up operation, thereby transferring a driving force applied from the motor to the pick-up gear.

While transmitting a picked-up sheet to a proper location for printing, a change gear is unlocked from pick-up gear by a restoring force of an elastic member, moving toward an end portion of a switching level along the guide bar in the axial direction, allowing to be engaged with a feed gear thereby causing a driving force to be transferred to the feed gear.

By doing so, a switching operation for picking up and feeding a sheet for printing process is achieved regardless worn of any gears employed in the apparatus thereby enhancing quality of a printer. In addition, in order to prevent excessive rotational movement of a switching level causing a change gear to deviate from feed gear by elastic member, a stopper is integrally formed on the body of a printer and provides a support for a switching level.

BRIEF DESCRIPTION OF THE DRAWINGS

A more detailed appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
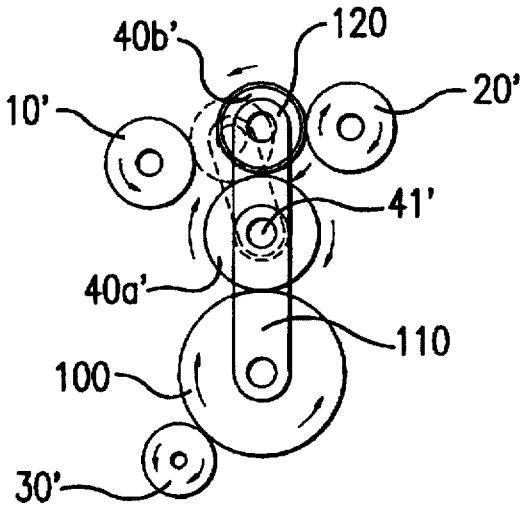
FIG. 1 PRIOR ART
FIG. 1 is a schematic sectional view illustrating a conventional sheet feeding device in a printer employing a fixed bracket and a relaying bracket.
Figure 2:
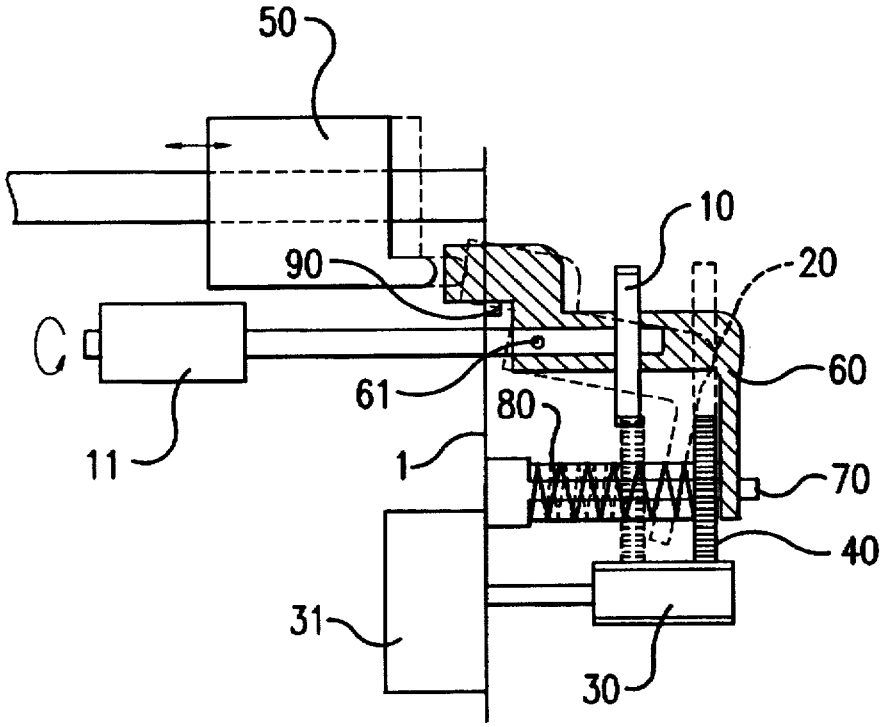
FIG. 2 is a schematic sectional elevation view of a sheet feeding apparatus constructed according to the principles of the present invention.

Turning now to the drawing and referring to FIG. 2, a preferred embodiment of a sheet feeding apparatus according to the present invention is illustrated. The sheet feeding apparatus includes a pick-up gear 10 coaxially linked with a pick-up roller 11 which is disposed to pick up a sheet from a tray; a feed gear 20 coaxially linked with a feed roller (not shown) that transmits a picked-up sheet to a location adequate for printing operation; a driving gear 30 in substantially rectangular shape that turns round forward and reverse by a driving force applied from a motor 31; a change gear 40 in mesh with and slidingly movable along driving gear 30, for transferring a driving force to either one of pick-up gear 10 or feed gear 20; a switching level 60 axially mounted on a shaft 61 connected to the body of a printer 1, for receiving a pulling force of a carriage 50 at its end, turning round with respect to shaft 61, and pushing change gear 40 with its another end so that the change gear is slidingly pulled and switched from an engagement with feed gear 20 to that with pick-up gear 10; a guide bar 70 fixedly install on the body of a printer 1 for guiding in the axle direction so that a change gear 40 slidingly moves along the peripheral surface of driving gear 30 and an elastic member 80 elastically disposed surrounding guide bar 70 for pushing change gear 40 in the direction toward a switching level 60 so that the charge gear 40 is able to be engaged with feed gear 80.

To prevent switching level 60 from excessive rotational movement so as not to cause change gear 40 to deviate from an engagement with feed gear 20 due to restoring force of elastic member 80, a stopper 90 is integrally formed on the body of a printer 1 so as to provide support for switching level 60.

Now, by way of a non-limiting example, an operation of a preferred embodiment of the present invention will be described in greater detail. On occasion of transmitting a picked-up sheet to a proper location for printing operation of a printer, change gear 40 is slidingly pushed by restoring force of elastic member 80, as illustrated in solid lines in FIG. 2, to mesh with feed gear 20. Then change gear 40 driver by a driving force of driving gear 30 transfers a driving force applied from motor 31 to feed gear 20, which in turn is transferred to feed roller thereby transmitting a sheet to a location adequate for printing.

In contrast, on the other occasion of picking up a sheet from a cassette, carriage 50 having a write head is forced to move toward switching level 60 since a printing operation is being ceased. Subsequent to the movement of a carriage, an end portion of switching level 60 is pushed by a protrusion of a carriage, rotating clockwise with respect to shaft 61, allowing another portion thereof to push change gear 40 toward to pick-up gear 10, and as shown by phantom lines in FIG. 2, thereby causing a deviation of change gear 40 from feed gear 20 to mesh with pick-up gear 10.

Here, change gear 40 moves slidingly in the axle direction of guide bar 70 along the peripheral surface of driving gear 30, thereby compressing elastic member 80. When a power supply is applied to motor 31 at an engagement state of change gear 40 and pick-up gear 10, a driving force produced is sequentially transferred to driving gear 30, change gear 40 and in turn to pick-up gear thereby allowing a sheet transmission. Upon transmission of a sheet to a proper location for a printing operation, motor 31 ceases operation.

Once a carriage is separated from a portion of swithcing level 60, then another portion thereof is forced to rotate with respect to shaft 61. As a result, restoring force of elastic member 80 releases change gear 40 from an engagement with pick-up gear 10, pulling change gear 40 to slidingly move along the peripheral surface of driving gear 30 in the axle direction of guide bar 70 and then to be engaged with feed gear 20. As noted previously, the above explanation gives one example of an operation for pick-up and feeding a sheet.

The above operation is repeatedly performed for printing and portraying characters or graphics on a sheet. With the construction as previously described, the teeth of any gears among driving gear 30, change gear 40 and pick-up gear 10 may be worn and tear, separately or collectively, and any clearances or increase gap created therebetween may vary.

However, a driving force is effectively transferred between various gears once they are engaged with each other thereby enhancing an efficiency of sheet feeding operation. In addition, stopper 90 is pretrudently formed on the surface of the body of a printer 1, supporting a portion of switching level 60 so as not to excessively rotate, and thereby preventing change gear 40 from being separated from feed gear 20 due to restoring force of elastic member 80.

As explained above, a preferred embodiment according to the present invention is able to transfer a driving force to a pick-up gear by moving and meshing change gear, during an operation for sheet pick-up by way of utilizing operational movements of both carriage and switching level.

On the other hand, in an operation for sheet feeding, a change gear in mesh with pick-up gear is deviated to engage with feed gear by restoring force of elastic member, thereby transferring driving force to feed roller. The above constructral features enables an effective and proper switching between pick-up and sheet feeding operations regardless of worn and tear of gears employed therein.

While there have been illustrated and described what are considered to be embodiments of the present invention, it will be understood by those skilled in the art that various changes and modifications may be make, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments failing within the scope of the appended claims.

What is claimed is:

1. A sheet feeding apparatus for use in a printer, said apparatus comprising:

a pick-up gear coaxially linked with a pick-up roller for picking up a sheet;

a feed gear coaxially linked with a feed roller for transmitting a picked-up sheet to a location for printing;

a driving gear in substantially rectangular shape, driven by a driving force applied from a motor;

a change gear engaged with the driving gear and slidingly movable along the peripheral surface thereof, for transferring a driving force applied from the driving gear to one of either the pick-up gear or feed gear;

a switching lever pivotly mounted on a shaft connected to the body of the printer, said lever being swiveled with respect to the shaft when a carriage pushes an arm thereof, and for causing the change gear to be released from an engagement with the feed gear and to be meshed with the pick-up gear;

a guide bar fixedly installed on the body of the printer, for guiding in the axial direction the change gear to slidingly move along the peripheral surface of the driving gear; and an elastic member elastically installed around the guide bar to shift the change gear from an engagement with the pick-up gear to an engagement with the feed gear, whereby the driving force produced from the motor is able to be transferred to the feed roller.

2. The apparatus of claim 1, wherein a stopper is protrudently formed on the body of the printer so as to support a portion of the switching level and prohibit an excessive rotational movement thereof and to prevent the change gear from being deviated, from an engagement with the feed gear by a restoring force of the elastic member.

* * * * *